US008454192B2

(12) United States Patent
Rouse et al.

(10) Patent No.: US 8,454,192 B2
(45) Date of Patent: Jun. 4, 2013

(54) STRIP LIGHTING FIXTURE WITH CHANNEL

(75) Inventors: Russell Vern Rouse, Oxford, GA (US); Peter M. Schmidt, Conyers, GA (US); John T. Mayfield, III, Loganville, GA (US)

(73) Assignee: ABL IP Holding LLC, Conyers, GA (US)

( * ) Notice: Subject to any disclaimer, the term of this patent is extended or adjusted under 35 U.S.C. 154(b) by 414 days.

(21) Appl. No.: 12/479,220

(22) Filed: Jun. 5, 2009

(65) Prior Publication Data

US 2010/0309658 A1 Dec. 9, 2010

(51) Int. Cl.
*F21Y 2101/02* (2006.01)

(52) U.S. Cl.
USPC ..... 362/217.12; 362/217.13; 362/217.16; 362/219; 362/225; 362/368; 362/170

(58) Field of Classification Search
USPC ..... 362/217.12, 217.13, 217.16, 219, 362/225, 148–150, 368, 170
See application file for complete search history.

(56) References Cited

U.S. PATENT DOCUMENTS 3,349,237 A * 10/1967 Jackson ..... 362/219
3,589,660 A * 6/1971 Dunckel ..... 248/343
3,673,402 A * 6/1972 Weiss ..... 362/220
4,976,633 A 12/1990 Beghelli
4,980,808 A 12/1990 Lilos
5,653,412 A * 8/1997 Martorano et al. ..... 248/222.11
5,658,066 A * 8/1997 Hirsch ..... 362/219
5,765,939 A * 6/1998 Tanner, Jr. ..... 362/219
5,791,764 A 8/1998 Jaksich
5,906,427 A * 5/1999 Noh ..... 362/223
6,220,721 B1 4/2001 Chan et al.
6,439,741 B1 8/2002 Diaz et al.
6,491,410 B2 12/2002 Ladstäitter et al.
6,601,976 B1 8/2003 Rhee
6,619,815 B2 9/2003 Southern, Jr.
6,659,623 B2 12/2003 Friend
7,036,955 B2 * 5/2006 Kazi et al. ..... 362/219
7,090,375 B2 8/2006 Kuisma
7,192,158 B2 3/2007 Eppler
7,296,911 B2 * 11/2007 Plunk et al. ..... 362/221
7,413,323 B2 8/2008 Lippis et al.
8,109,648 B2 * 2/2012 Laso et al. ..... 362/217.13
2006/0023450 A1 2/2006 Chung et al.
2006/0249633 A1 11/2006 Korczak et al.
2007/0102613 A1 5/2007 Wallace
2007/0114337 A1 5/2007 Rommelmann, Jr.

* cited by examiner

*Primary Examiner* — Robert May
*Assistant Examiner* — Tsion Tumebo
(74) *Attorney, Agent, or Firm* — Kilpatrick Townsend & Stockton LLP

(57) ABSTRACT

Described are strip lighting fixtures having a channel defined by a base plate and two side walls, end plates located at each end of the channel, and a channel cover that snap-fits onto the channel. The channel side walls include at least one gripper indentation that releasably engages with at least one tong hanger hook via a snap-fit connection to attach the strip fixture to a support structure. As examples, the tong hangers include hooker clips that connect the tong hanger to a support structure, and the channel cover is contoured to provide additional spacing or relief areas to avoid pinched wires when the channel cover is connected to the channel.

16 Claims, 14 Drawing Sheets

STRIP LIGHTING FIXTURE WITH CHANNEL

FIELD OF THE INVENTION

Embodiments of the invention relate to lighting fixtures.

BACKGROUND OF THE INVENTION

Traditional strip lighting fixtures have included a substantially rectilinear channel defined by a base and two upstanding side walls and an end plate positioned on each end of a channel. Collectively, the channel and the end plates define a channel cavity for housing the electronic fixture components, such as the ballast. A channel cover is positioned on and attached to the channel to enclose the electronic components. Socket brackets extend from the channel and receive lamps.

In use, the channel, which is positioned so that the channel base is positioned proximate the ceiling, is suspended from a ceiling with a tong hanger. The tong hanger has downwardly extending arms that engage each of the side walls of the channel. Traditionally, as shown in FIG. 1, a fastener, such as a bolt or other fastening means, is inserted to extend the width of the tong hanger. By tightening the bolt, the tong hanger grips the channel tighter, thus suspending the channel from the ceiling. Oftentimes, the channel is crushed by the tong hanger during this process.

In some cases, it may be desirable to install strip fixtures end-to-end to give the appearance of a continuous light fixture. Traditionally, this type of installation required the removal of the end plates from adjacent fixtures to create an open channel between the fixtures. As shown in FIG. 2, one of the end plates was then oriented to span the seam between the adjacent fixtures and secured in place on each fixture, such as via insertion of the edges of the end plates into grooves provided in the bases of the fixtures. In this manner, the end plate also functioned as a connector between adjacent fixtures. However, given the geometry of the end plates, they failed to reinforce the entire seam between the adjacent fixtures. Rather, they only buttressed the seam along the bottom (not sides) of the channel. Thus, such end plates failed to impart sufficient rigidity and support at the seam between adjacent channels, which in turn were susceptible to undesired relative movement and improper alignment as a result. Moreover, when used as a connector, the side walls of the end plates, which normally would be aligned parallel with the side walls of the channel, extended upwardly into the channel, creating an obstruction in the open channel between the fixtures and hindering wire routing.

SUMMARY OF EMBODIMENTS OF THE INVENTION

Embodiments of the invention provide strip lighting fixtures. In one embodiment, the strip fixture includes a channel defined by a base plate and two side walls, end plates located at each end of the channel, and a channel cover that snap-fits onto the channel to form an electronic enclosure for the ballast and other fixture components.

In some embodiments, the channel side walls may include at least one gripper indentation that engages with a tong hanger to attach the strip fixture to a support structure. In one embodiment, the tong hanger includes a base plate and side arms, where the side arms have tong hanger hooks that releasably engage the gripper indentations via a snap-fit connection. Thus, the tong hanger may support the weight of the strip fixture without requiring additional mechanical fasteners. For purposes of this application, the term "releasably" (as in releasably engage or secure) is intended to mean without the use of separate mechanical fasteners.

In some embodiments, the tong hanger includes fasteners on the tong hanger base plate to connect the tong hanger to a support structure in various orientations. In one embodiment, hooker clips are affixed to the tong hanger base plate, which are designed to connect the tong hanger to the lower flange of a T-bar. In one method of installation, the tong hanger is affixed to a support structure with hooker clips, the channel is snap-fitted onto the tong hanger, and the channel cover is snap-fitted onto the channel without the need for separate mechanical fasteners or tools.

In some embodiments, socket brackets are connected to the channel, with lamp sockets in turn connected to the socket brackets. The wiring from the lamp sockets and ballasts may be located within the channel. In some embodiments, the channel cover is contoured to provide additional spacing or relief areas to avoid pinching wires between the channel cover and the socket bracket and/or the channel. In other embodiments, a lamp reflector may be used in conjunction with, or in place of, the channel cover. The lamp reflector enhances directional control of the lamp output.

In some embodiments, multiple strip fixtures may be secured end-to-end to create the appearance of a continuous lighting fixture. To connect these strip fixtures, an end plate is removed from one end of each strip fixture, and the open ends of each strip fixture are positioned adjacent one another to form a seam. In some embodiments, a channel aligner is used to span the seam and connect the adjacent open ends of the two strip fixtures. To provide additional lateral stability, the channel aligner may also have wings that releasably engage with the channel side walls.

DETAILED DESCRIPTION OF EMBODIMENTS OF THE INVENTION

Embodiments of the invention provide strip lighting fixtures. While the strip lighting fixtures are discussed for installation with tong hangers, they are by no means so limited. Rather, embodiments of the strip lighting fixtures may be installed with fastening devices of any type.

Figure 3:
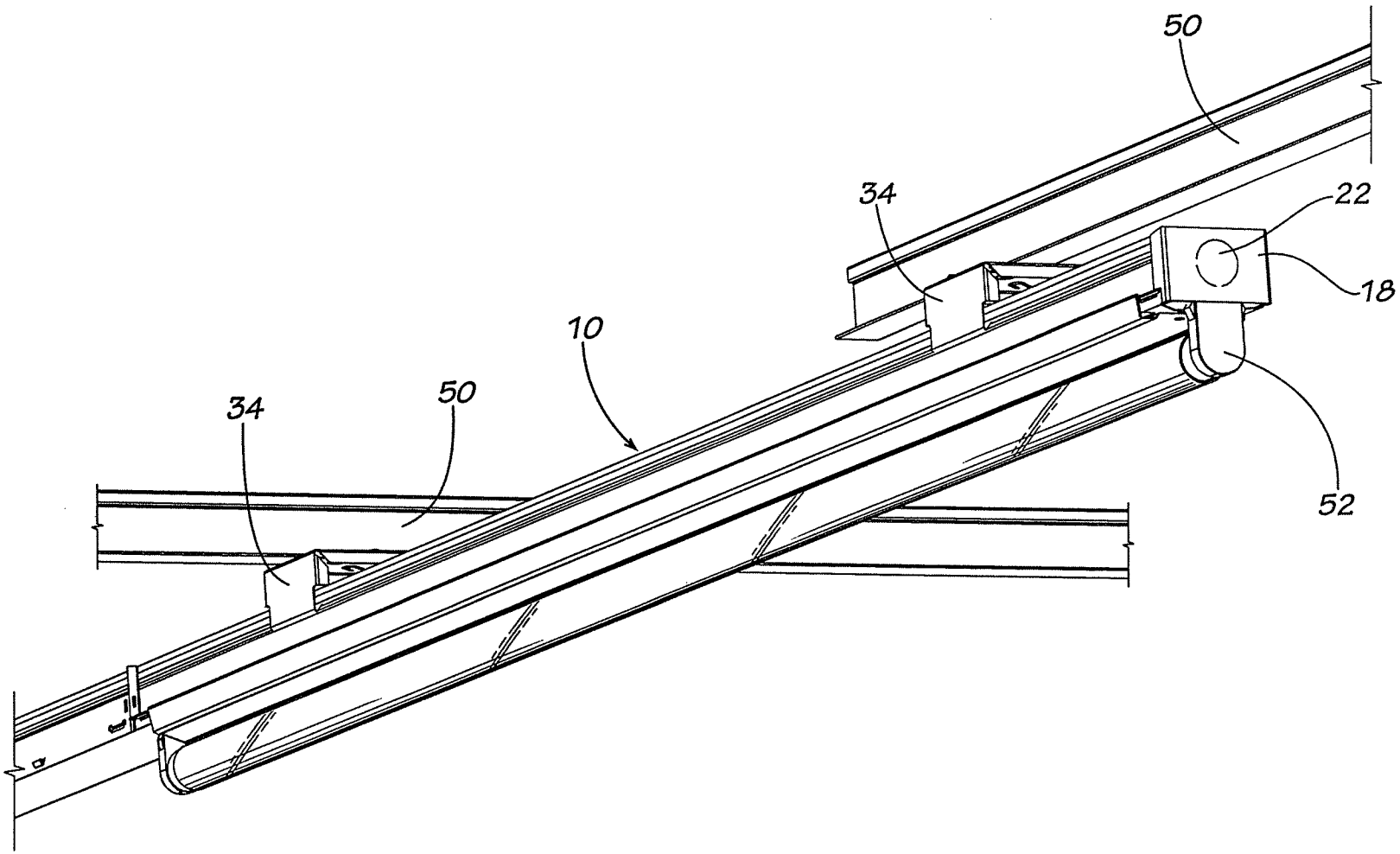
FIG. 3 is a perspective view of a fully assembled strip fixture according to one embodiment of the present invention.
Figure 4:
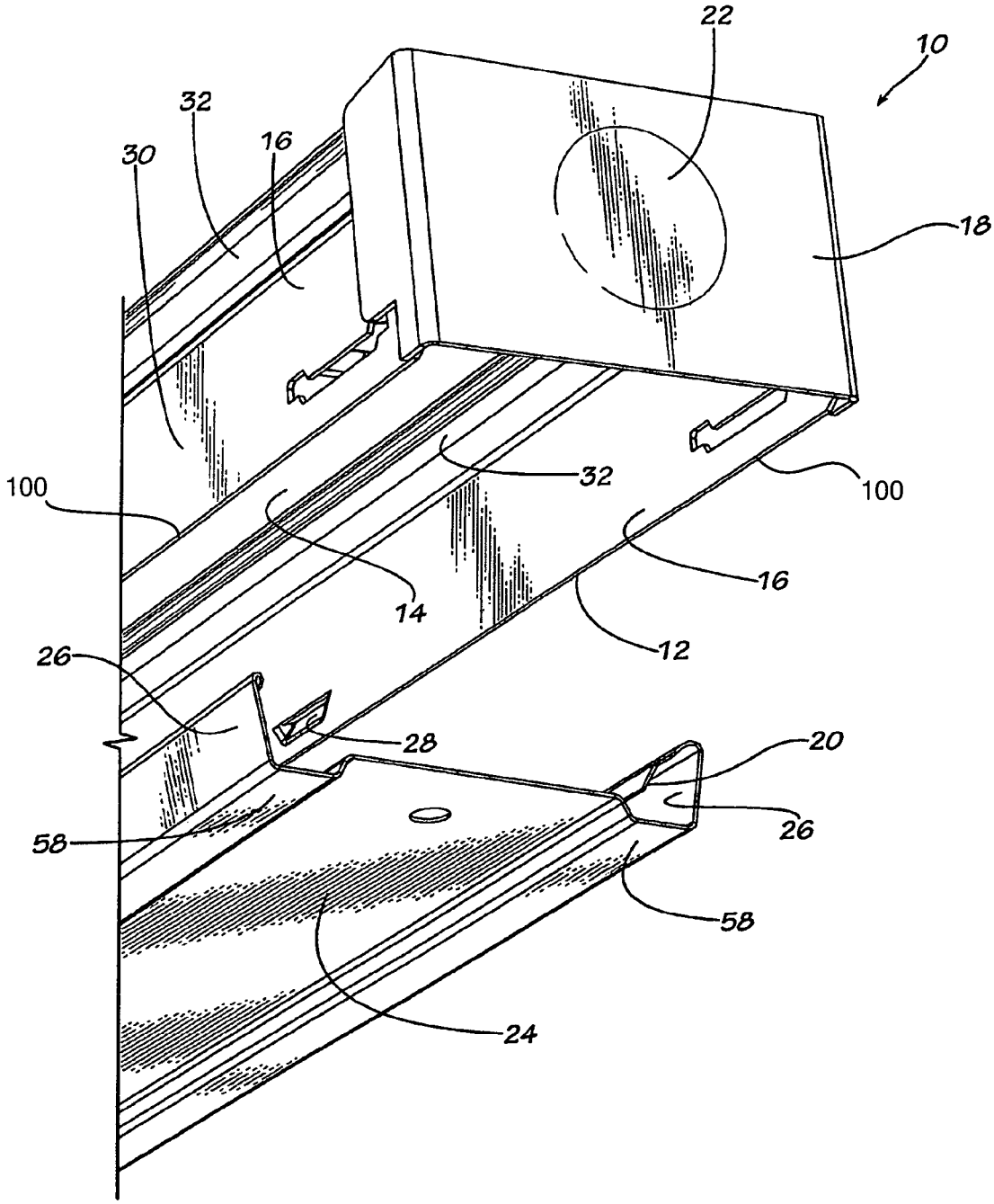
FIG. 4 is a bottom perspective view of a strip fixture according to one embodiment of the present invention.

FIGS. 3 and 4 illustrates one embodiment of a strip fixture 10. As shown in FIG. 4, the strip fixture 10 includes a channel 12 defined by a base plate 14 and two side walls 16 that extend upwardly from the base plate 14 and terminate in distal ends 100. End plates 18 are positioned at each end of the channel 12 and a channel cover 20 is positioned onto the channel 12 to form an electronic enclosure for the ballast and other fixture components. End plates 18 may be attached to the channel 12 by any suitable fastening device, including devices such as snaps or rivets. End plates 18 may also incorporate a "knock-out" area 22 allowing easy field installation of conduit through the fixture end plate 18.

The components of strip fixture 10 may be formed of any material(s) having sufficient structural integrity. Suitable materials include, but are not limited to, metallic and polymeric materials. In some embodiments, the strip fixture 10 components are formed from metal, such as 22 or 26 gauge steel. It may be desirable, but certainly not necessary, to treat some surfaces of the strip fixture 10 (such as the channel cover) to be reflective, such as via application of a highly reflective paint.

Conventionally, channel covers have been attached to channels with screws, ¼ turn fasteners, etc. While one of skill in the art will understand that the channel cover 20 may be attached to the channel 12 through the use of any suitable fastening device (including those used in the past), it is preferable, but not required, that the channel cover 20 be installed onto the channel 12 without the use of mechanical fasteners. In one such embodiment, the channel cover 20 has a base 24 and sides 26 that extend over side walls 16 and releasably engage with a lance 28 on the outer surface 30 of side walls 16. Thus, the channel cover 20 snap-fits onto the channel 12 without the need for any additional mechanical fasteners. As a result, the channel cover 20 is easily removed to access electrical components housed therein.

Figure 5:
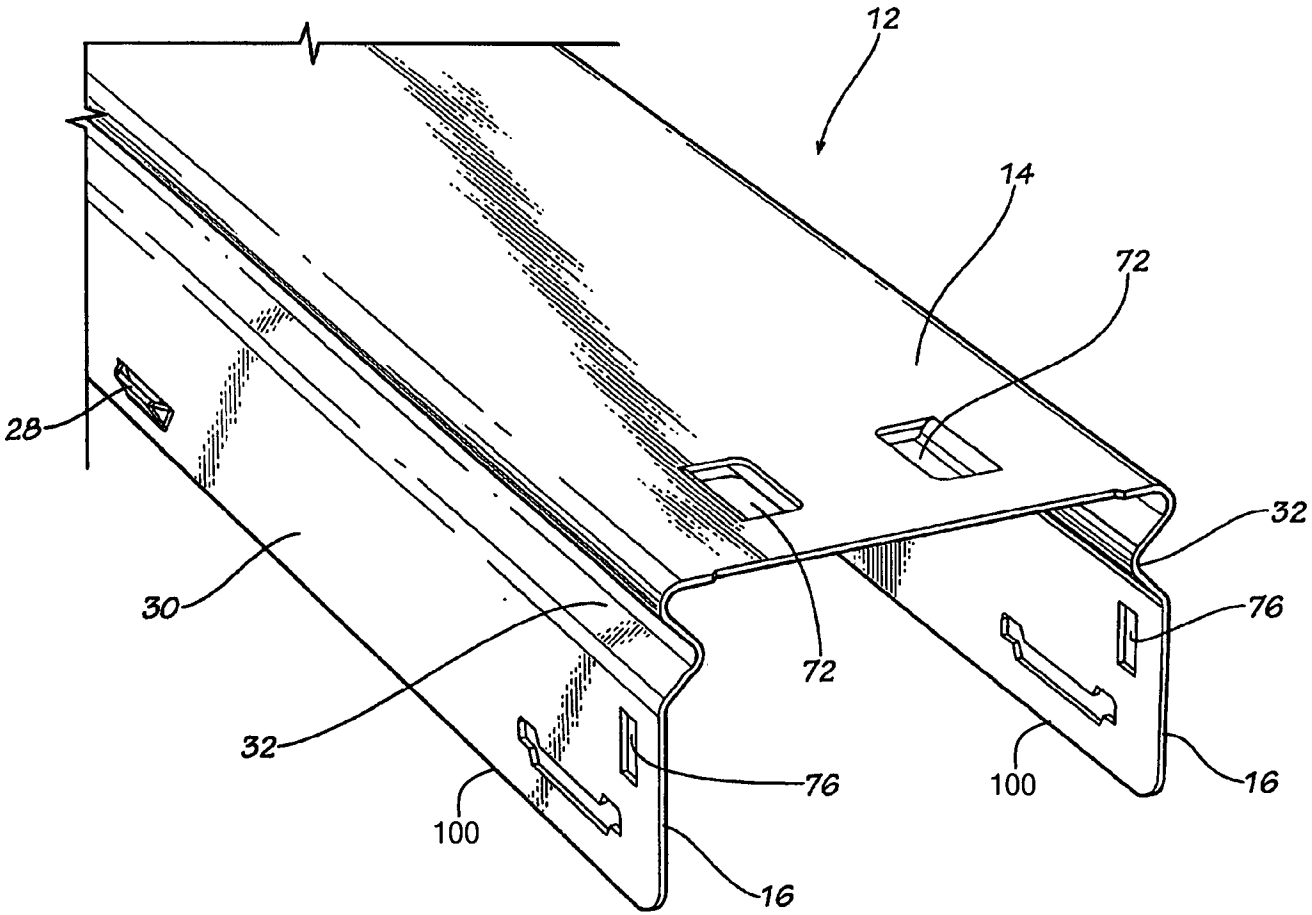
FIG. 5 is a top perspective view of a channel according to one embodiment of the present invention.
Figure 6:
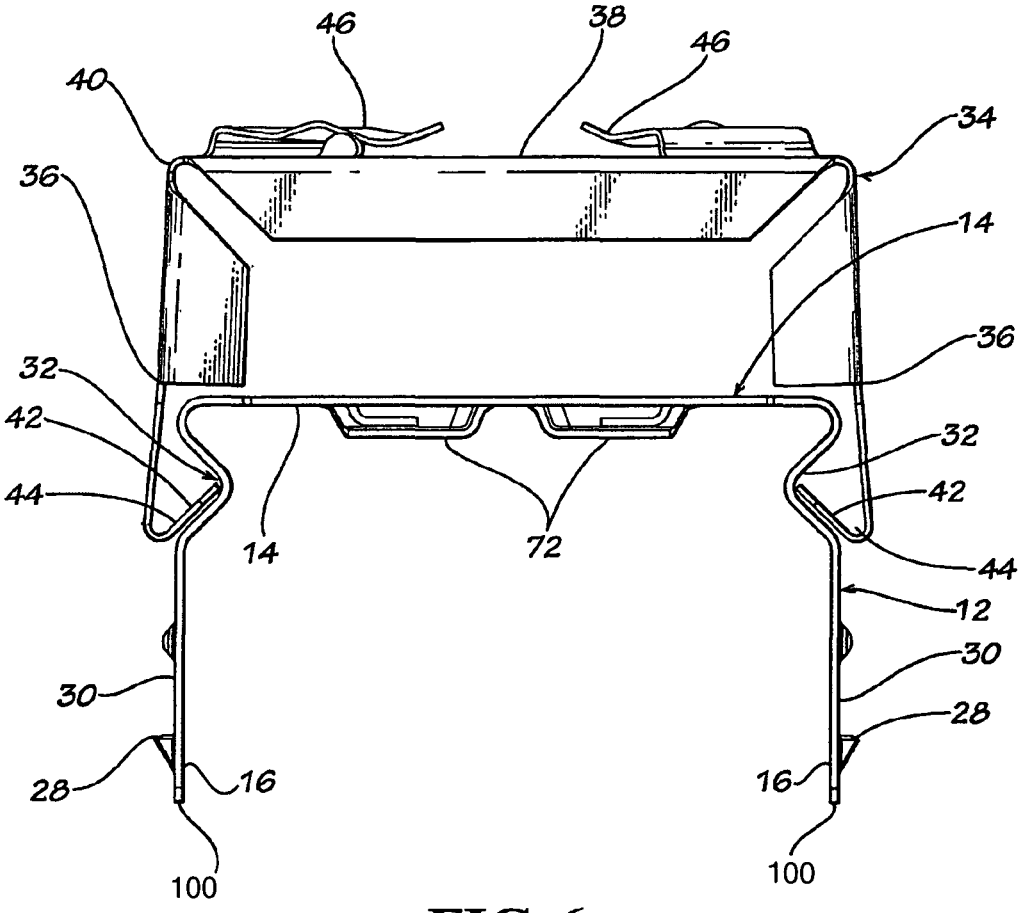
FIG. 6 is a cross-sectional view of a channel and tong hanger according to one embodiment of the present invention.

As shown in FIGS. 4-6, each side wall 16 includes at least one gripper indentation 32, which may extend continuously along the length of the side wall 16 adjacent the base plate 14. In other embodiments, the side wall 16 may include multiple gripper indentations 32 positioned intermittently along the length of the side wall 16. While the illustrated gripper indentation 32 is V-shaped, one of skill in the art will understand that the gripper indentation 32 may be any shape, including U-shaped, L-shaped, rounded, rectangular, and the like.

Figure 7:
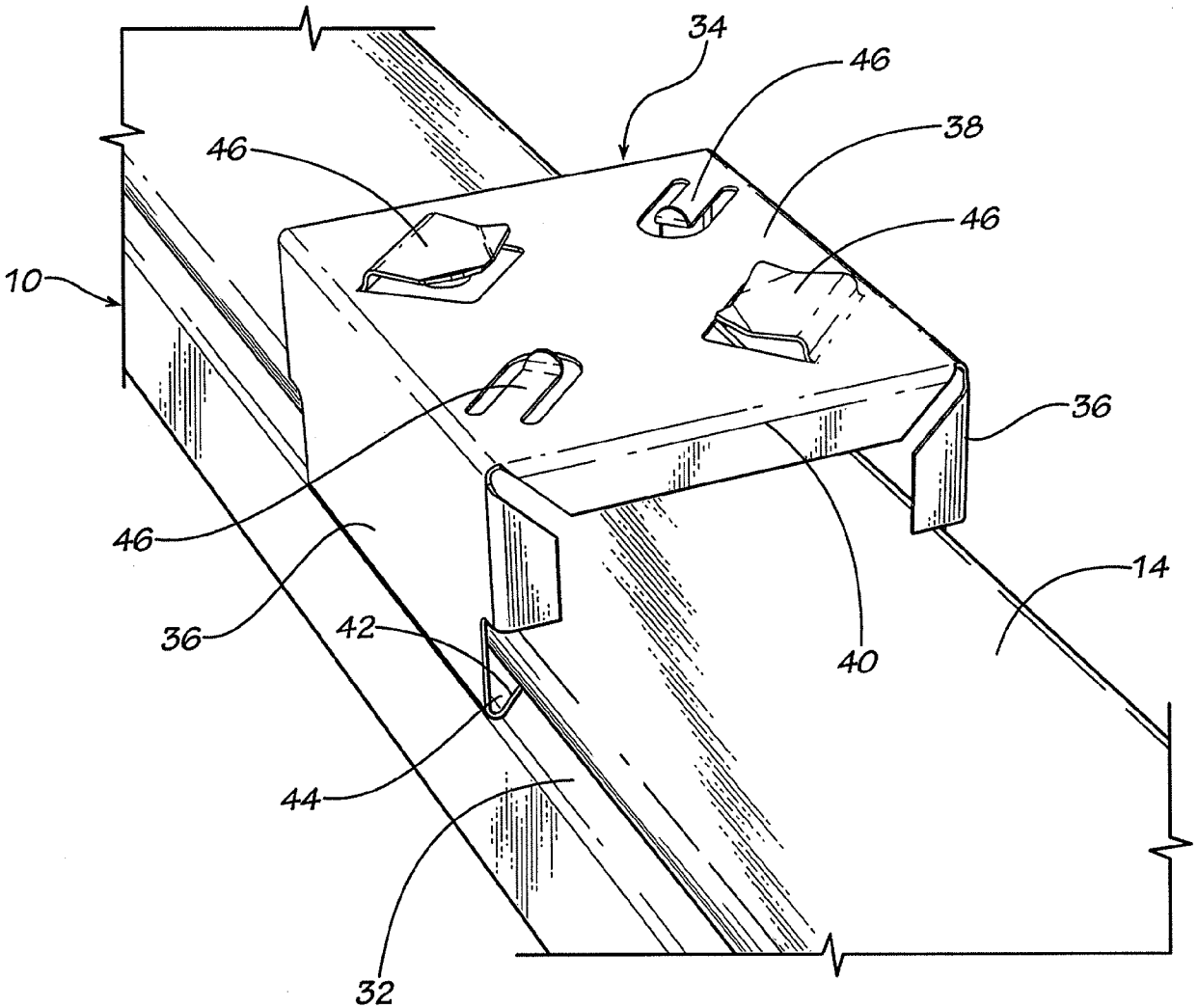
FIG. 7 is a top perspective view of a channel and tong hanger according to one embodiment of the present invention.

One of skill in the art will understand that the strip fixture 10 may be affixed to a support surface, such as a ceiling, by any suitable mechanical or chemical fastening device. In one embodiment, as shown in FIGS. 6-7, the strip fixture 10 is attached to a support structure with a tong hanger 34 as a fastening device. In one embodiment, the tong hanger 34 includes side arms 36 and a tong hanger base plate 38, where the side arms 36 extend outwardly from the tong hanger base plate 38, forming a tong hanger channel 40. Ends 42 of side arms 36 are bent inwardly towards the tong hanger channel 40, resulting in the formation of a tong hanger hook 44. While the illustrated tong hanger hook 44 is V-shaped, one of skill in the art will understand that the tong hanger hook 44 may be any shape, including U-shaped, L-shaped, rounded, rectangular, and the like. The tong hanger 34 may be formed of any material having sufficient yield strength to allow the side arms 36 to be resilient in that they return to their original position relative to the base plate 38 after flexing or bending. Suitable materials include, but are not limited to, metallic and polymeric materials. In some embodiments, the tong hanger 34 is formed from metal, such as spring steel, or other similar material. In some embodiments, the tong hanger side arms 36 and base plate 38 are integrally-formed.

Figure 1:
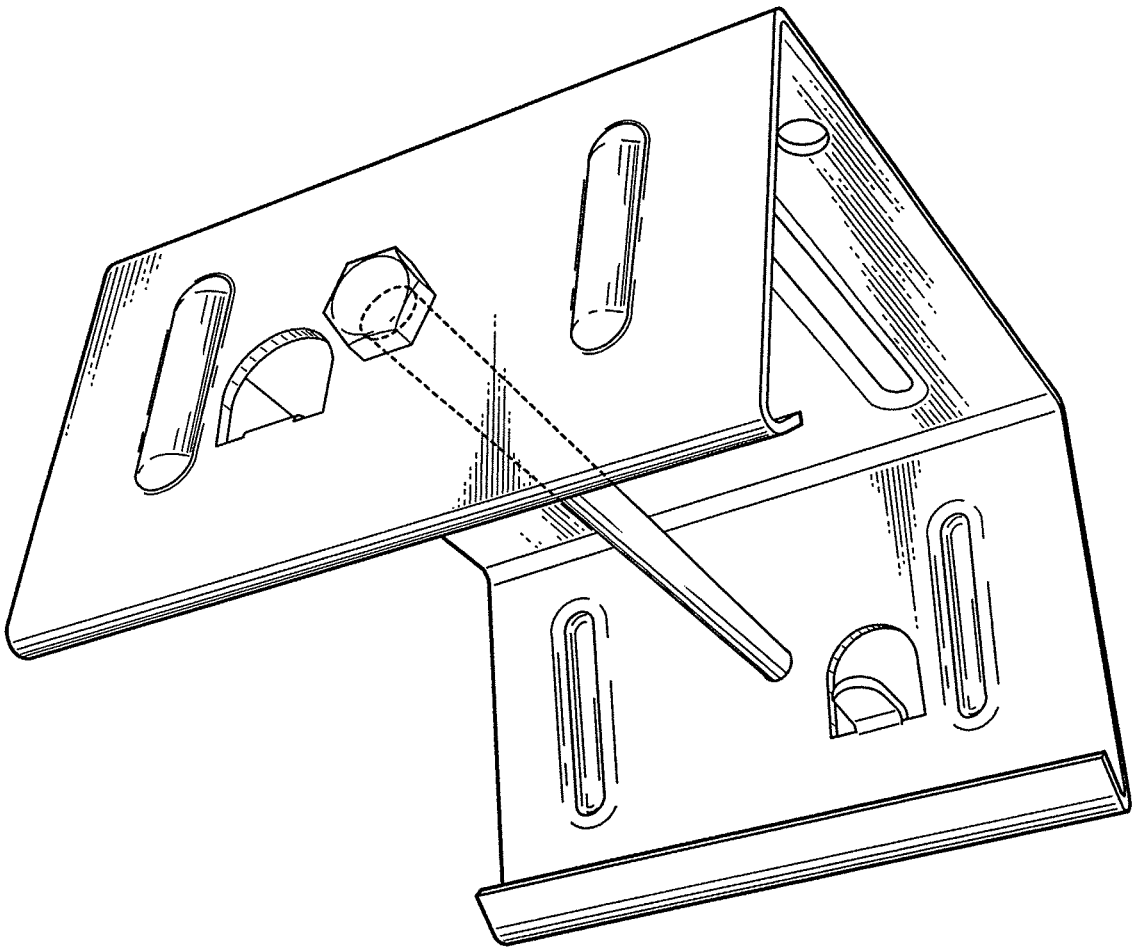
Prior Art FIG. 1
FIG. 1 is a bottom perspective view of a traditional tong hanger.

In use, the strip fixture 10 is positioned relative to the tong hanger 34 so that the base plate 14 is received in the tong hanger channel 40. The strip fixture 10 is releasably attached to the tong hanger 34 via snap-fit engagement of the tong hanger hooks 44 in the gripper indentations 32 located on the side walls 16 of the channel 12. Insertion of the channel 12 into the tong hanger channel 40 causes the side arms 36 to flex outwardly from their resting state when the base plate 14 passes through the tong hanger hooks 44. Because the side arms 36 are resilient, they then contract inwardly so that the tong hanger hooks 44 engage the gripper indentations 32. The material properties of the tong hanger 34 also allow the side arms 36 to return to a resting state after the strip fixture 10 has been removed, providing for a repeatable snap-fit connection between the strip fixture 10 and the tong hanger 34. Thus, the tong hanger 34 supports the weight of the strip fixture 10 without the need for additional mechanical fasteners or other retention devices as has historically been the case, as illustrated by the traditional tong hanger shown in FIG. 1.

Figure 8:
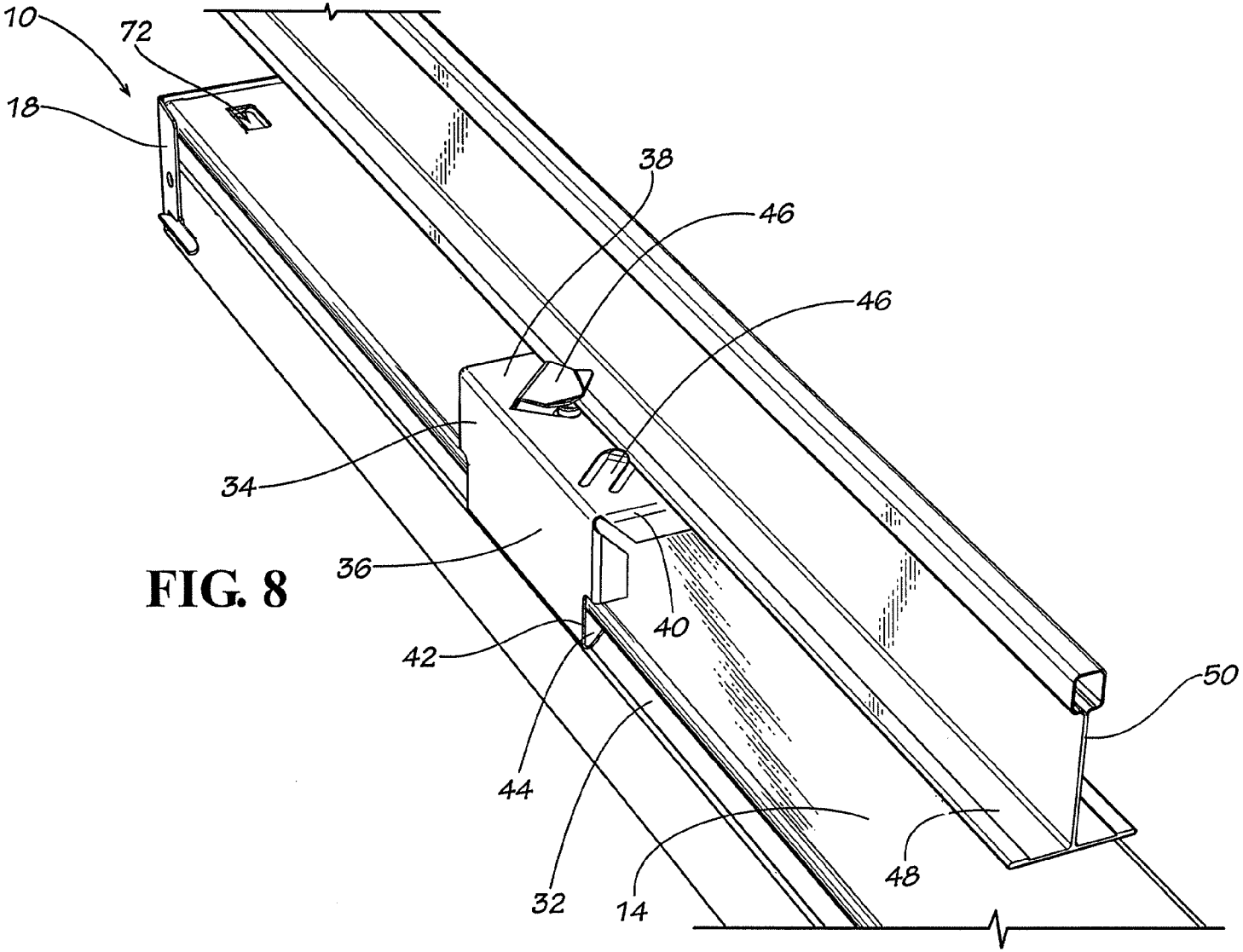
FIG. 8 is a top perspective view of a channel and tong hanger connected to a support surface in a parallel orientation according to one embodiment of the present invention.
Figure 9:
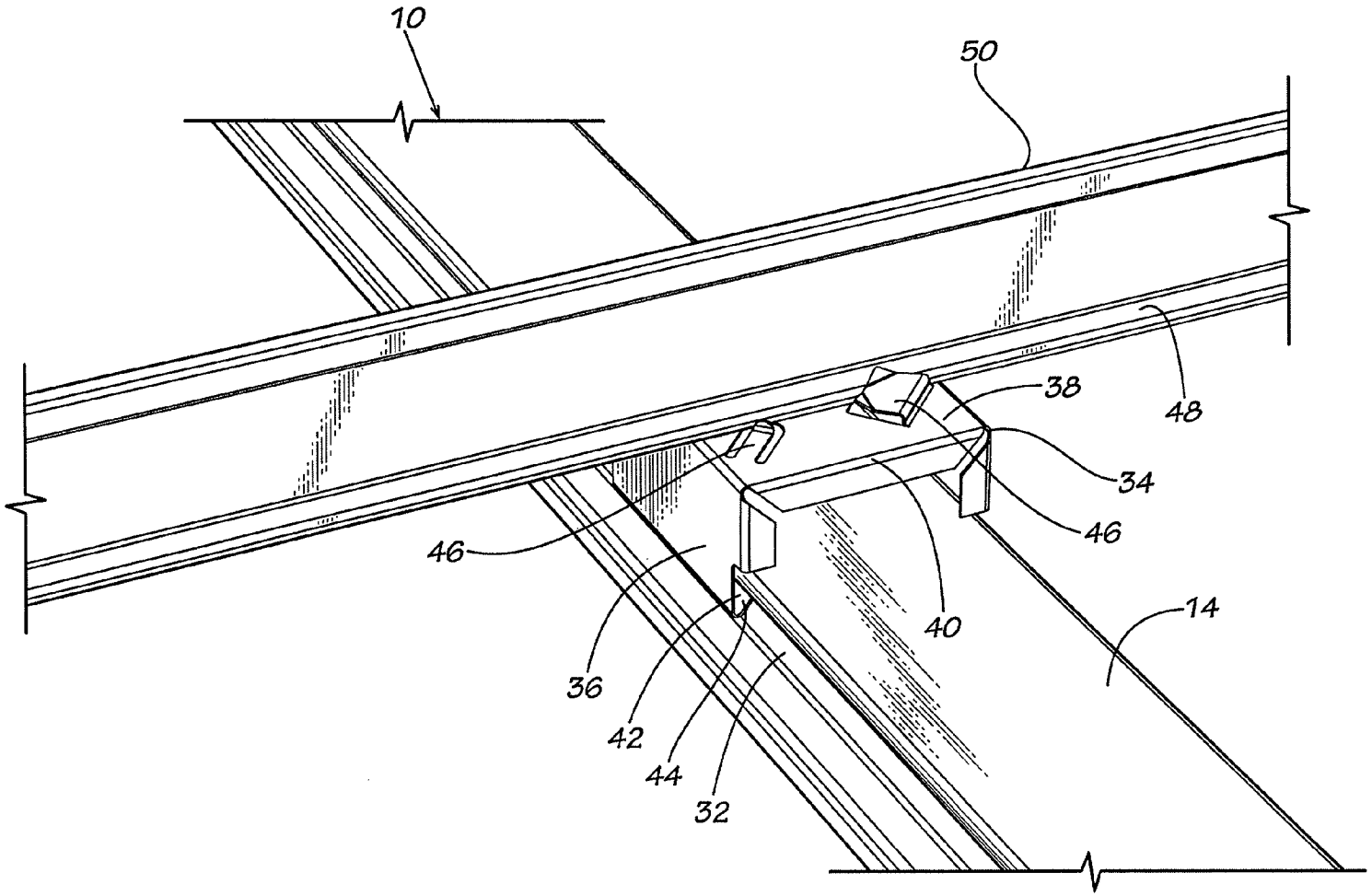
FIG. 9 is a top perspective view of a channel and tong hanger connected to a support surface in a perpendicular orientation according to one embodiment of the present invention.

As shown in FIGS. 7-9, the tong hanger base plate 38 of the tong hanger 34 may include clips or other fastening devices (including screws, bolts, and other mechanical fasteners) to affix the tong hanger 34 to a support structure, such as a ceiling. One of skill in the art will understand that any fastening device may be used to secure the tong hanger 34 to a support surface. In some embodiments, the tong hanger 34 includes hooker clips 46. Hooker clips 46 may be integrally formed as part of the tong hanger base plate 38 or attached to the tong hanger base plate 38 through any suitable connection means. In one embodiment, hooker clips 46 are designed to connect to a lower flange 48 of a T-bar 50 in a ceiling. In FIG. 8, hooker clips 46 are connected to the lower flange 48, where the T-bar 50 is oriented substantially parallel to the strip fixture 10. In FIG. 9, hooker clips 46 are connected to the lower flange 48, where the T-bar 50 is oriented substantially perpendicular to the strip fixture 10. Accordingly, the tong hanger 34 may be affixed to the T-bar 50 in multiple orientations without the use of additional mechanical fasteners or tools.

The tong hanger 34 may be installed on the T-bar 50 prior or subsequent to attachment of the strip fixture 10 on the tong hanger 34. In one method of installation, the tong hanger 34 is positioned on the T-Bar 50 with hooker clips 46, the channel 12 is snap-fitted onto the tong hanger 34, the channel cover 20 is snap-fitted onto the channel 12, and the bulbs are positioned in the sockets 52. This entire installation process occurs without the need for separate mechanical fasteners or tools for use with such fasteners, as has historically been the case.

Figure 10:
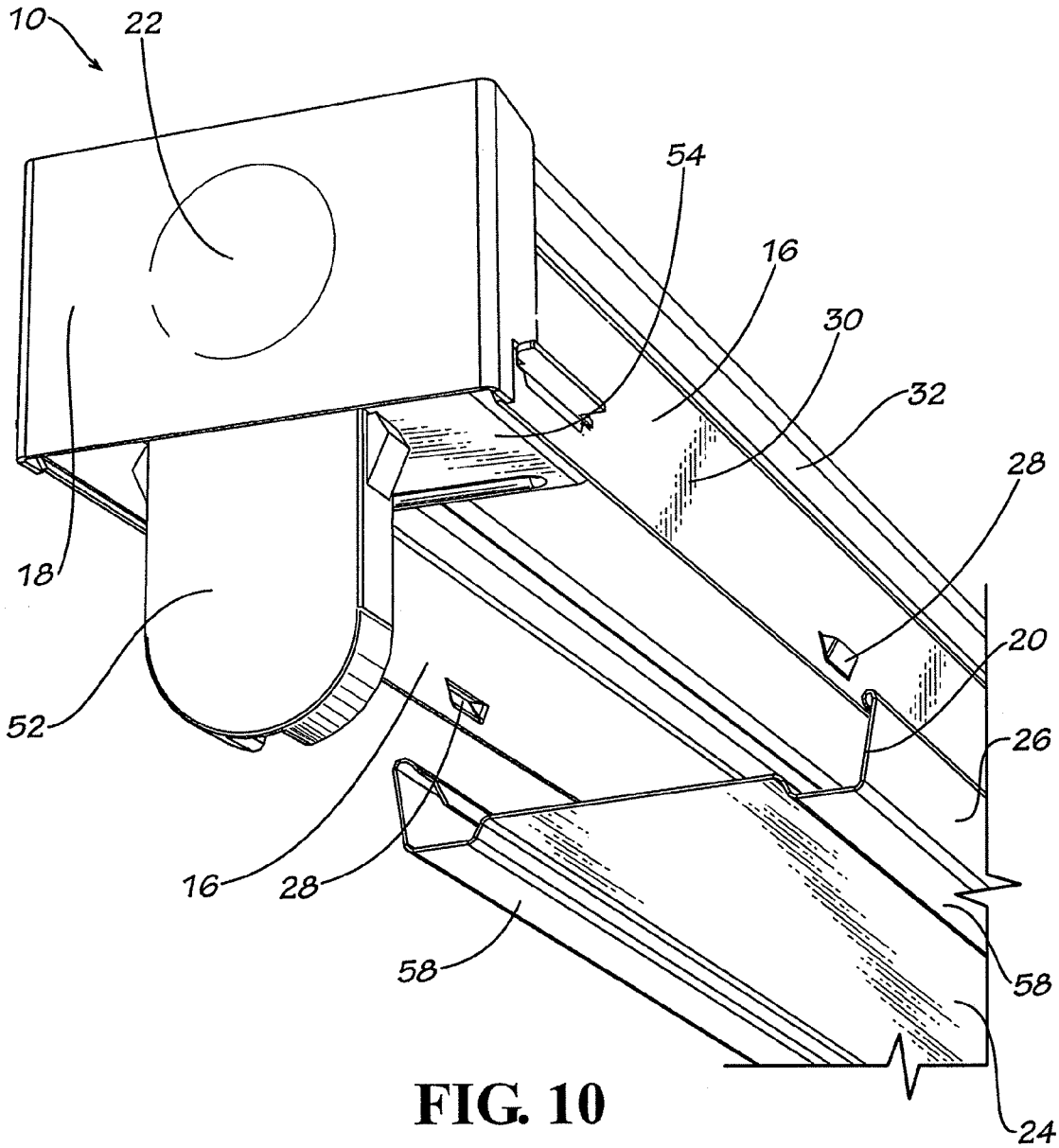
FIG. 10 is a bottom perspective view of a strip fixture with socket bracket and socket according to one embodiment of the present invention.
Figure 11:
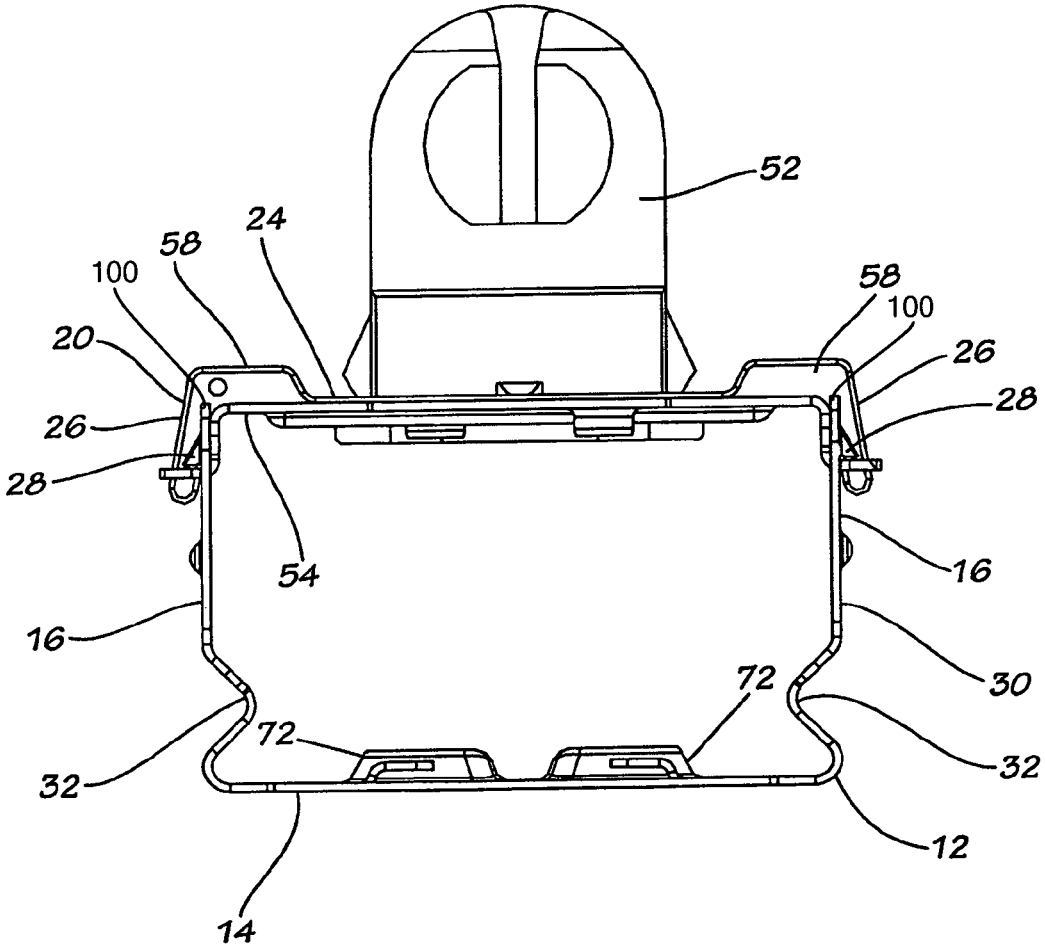
FIG. 11 is a cross-sectional view of a strip fixture and socket bracket with channel cover installed according to one embodiment of the present invention.

As shown in FIGS. 10-11, socket brackets 54 may be attached to the channel 12 by any suitable means, including snap-fit. In some embodiments, the socket brackets 54 provide proper lamp spacing for strip fixture 10. The socket bracket 54 may be formed of any material having sufficient structural integrity. Suitable materials include, but are not limited to, metallic and polymeric materials. In some embodiments, the socket bracket 54 is formed from metal, such as 20 gauge steel. It may be desirable, but certainly not necessary, to treat the surface of the socket bracket 54 to be reflective, such as via application of a highly reflective paint.

Lamp sockets 52 (mounted on socket brackets) for retaining lamps (not shown) may be provided on the strip fixture 10 via connection to socket brackets 54, as is commonly known and done in the art. Wiring from the lamp sockets 52 is routed within the channel 12. When connecting the channel cover 20 to the socket bracket 54 and/or channel 12, such wiring can become pinched between the channel cover 20 and the socket bracket 54 and/or the channel 12, thereby jeopardizing operation of the fixture. Embodiments of channel covers contemplated herein preferably, but not necessarily, are contoured to provide additional spacing or relief areas for wire routing. For example and as shown in FIGS. 10 and 11, the base 24 of the channel cover 20 is not planar, but rather includes relief channels 58 that run along at least a portion of the length of the channel cover 20.

While the illustrated relief channels 58 are substantially rectilinear-shaped recesses, one of skill in the art will understand that relief channels 58 may be of any shape. When the channel cover 20 is connected to the strip fixture 10, relief channels 58 create spacing within the cavity of the strip fixture 10 for wire routing, thereby reducing the risk that wires will become pinched and thereby jeopardize operation of the fixture.

Figure 12:
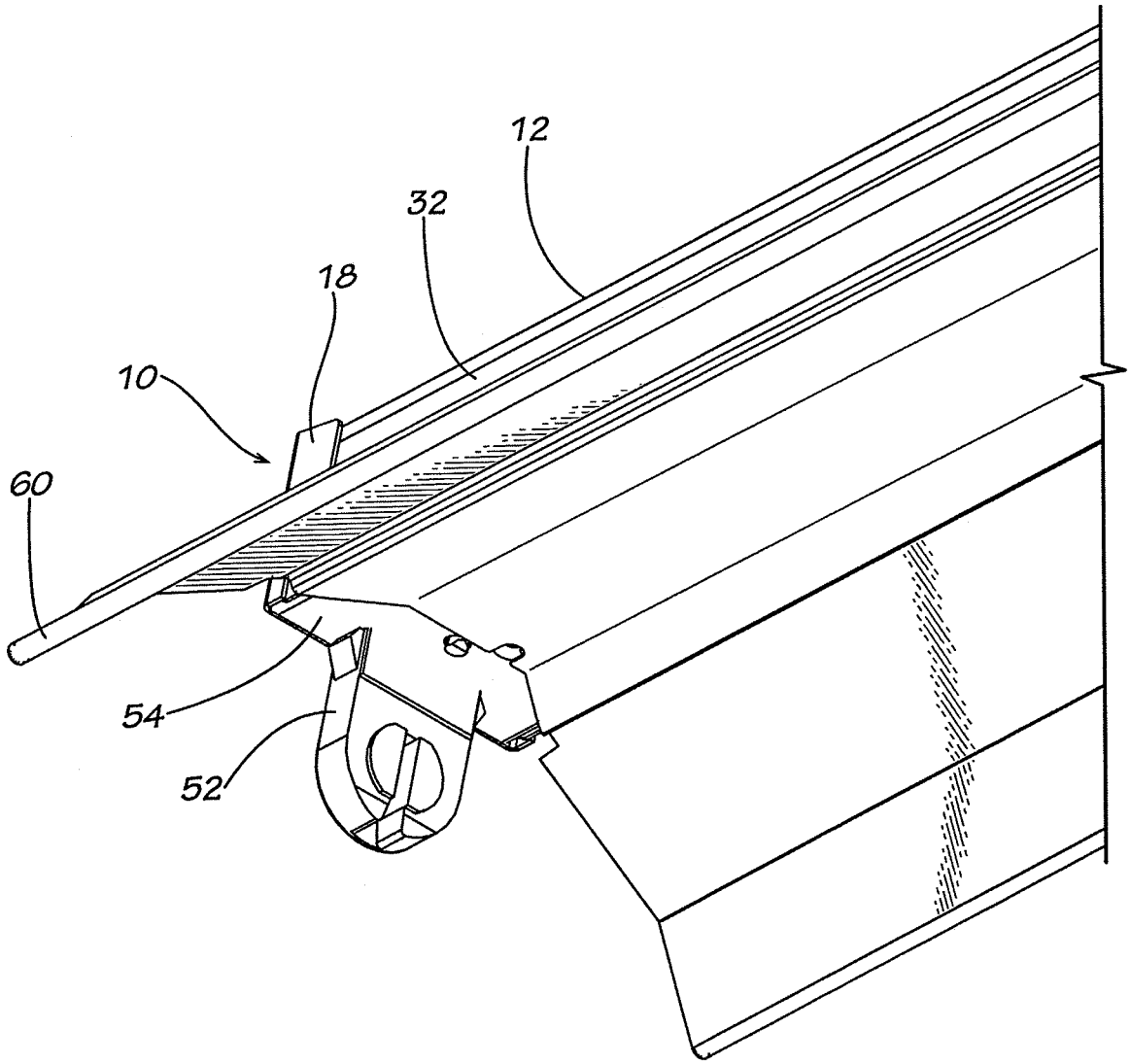
FIG. 12 is a bottom perspective view of a strip fixture with lamp reflector according to one embodiment of the present invention.

In some embodiments, as shown in FIG. 12, a lamp reflector 60 may be installed on the strip fixture 10 in conjunction with, or in place of, the channel cover 20. The lamp reflector 60 enhances directional control of the lamp output. In one embodiment, the lamp reflector 60 is attached to the socket brackets 54 with mechanical fasteners. However, one of skill in the art will understand that the lamp reflector 60 may be attached to other components of the strip fixture 10 with any suitable fastening device.

Figure 13:
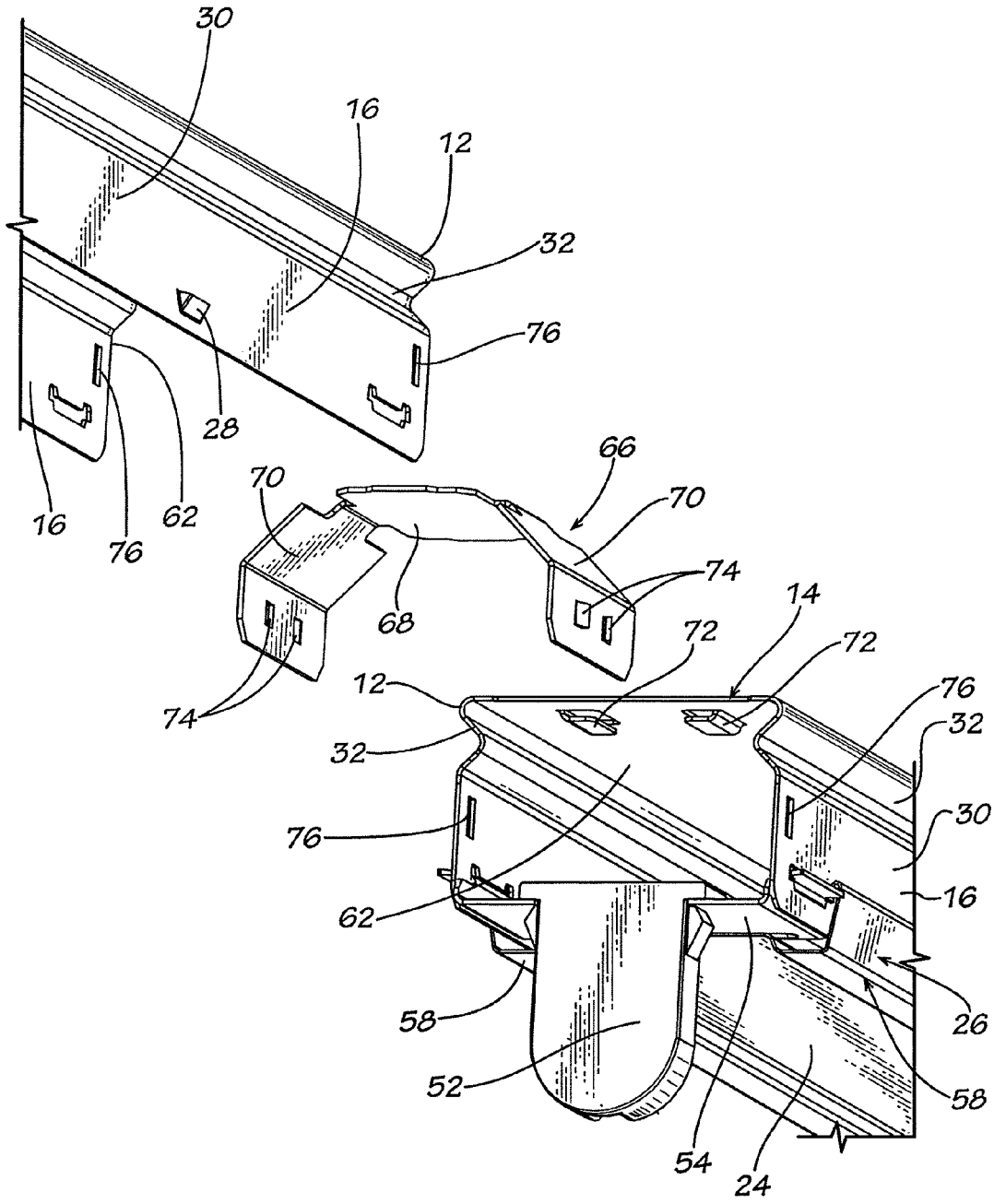
FIG. 13 is an exploded view of a channel aligner and two strip fixtures according to one embodiment of the present invention.
Figure 14:
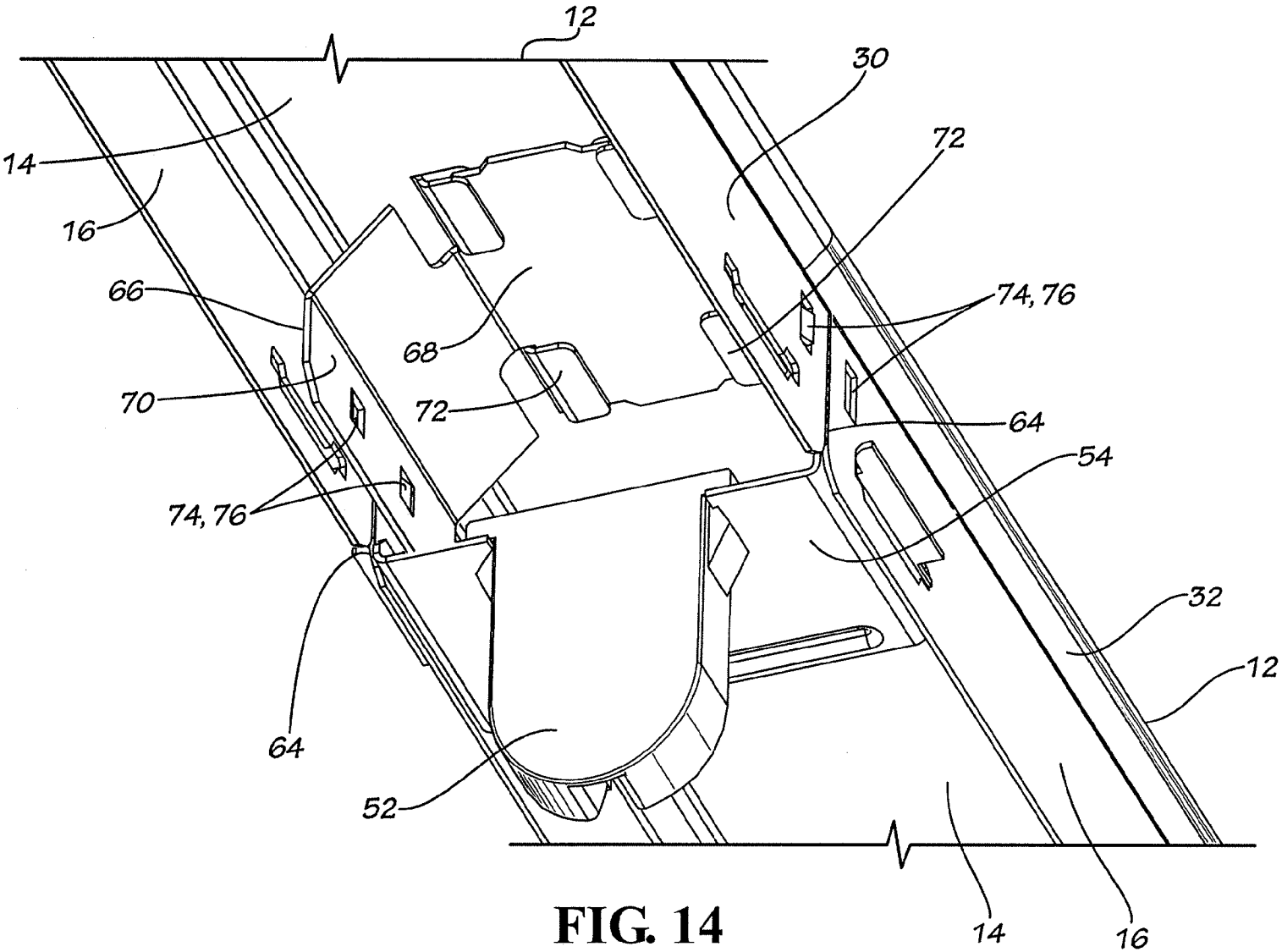
FIG. 14 is a bottom perspective view of an assembled channel aligner and two strip fixtures according to one embodiment of the present invention.

In some embodiments, as shown in FIGS. 13-14, multiple strip fixtures 10 may be secured together end-to-end to create the appearance of a continuous lighting fixture. One of skill in the art will understand that strip fixtures 10 may be attached together by any suitable mechanical or chemical devices. In one embodiment, when connecting two strip fixtures 10, the adjacent end plates 18 of the strip fixtures 10 are removed. After the end plates 18 are removed, the open ends 62 of the two strip fixtures 10 are positioned adjacent one another to form a seam 64.

In some embodiments, a channel aligner 66 is used to span the seam 64 and thereby connect adjacent open ends 62 of the two strip fixtures 10. While the illustrated channel aligner 66 is shaped to substantially correspond to the cross-sectional shape of the channel 12, one of skill in the art will understand that the channel aligner 66 may be any shape that provides a device to connect the open ends 62 of adjacent strip fixtures 10. In one embodiment, the channel aligner 66 has a channel aligner base plate 68 and wings 70 that extend upwardly from the channel aligner base plate 68. When the channel aligner 66 is positioned to span the seam 64 between the two strip fixtures 10, almost the entirety of the seam 64 is buttressed by the channel aligner 66 to impart a rigid, structurally sound connection between the two strip fixtures 10.

Figure 2:
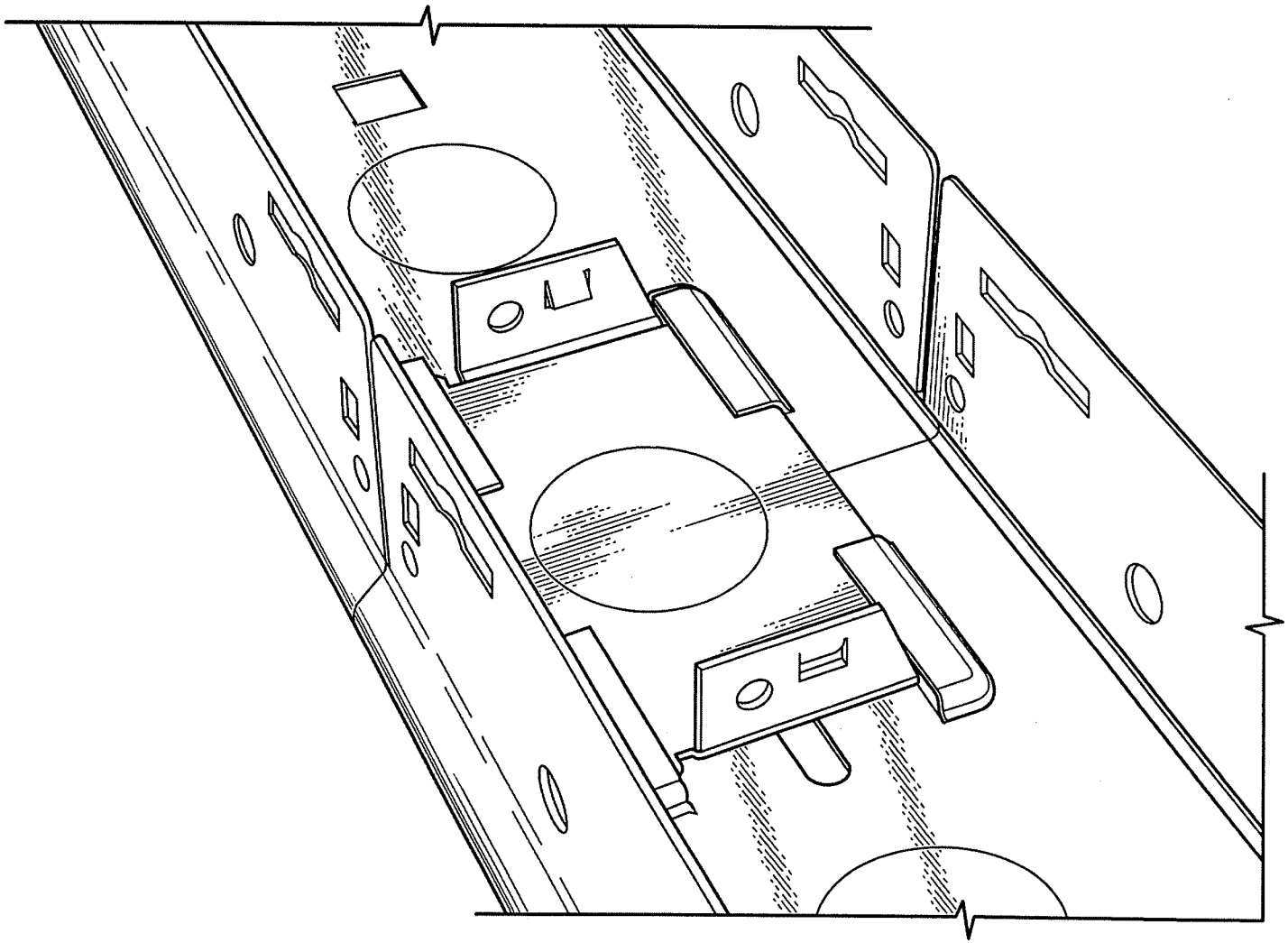
Prior Art FIG. 2
FIG. 2 is a bottom perspective view of an end plate used to join two adjacent strip fixtures.

The channel aligner 66 may be secured in place to the strip fixtures 10 using any mechanical retention means. In the illustrated and non-limiting embodiment shown in FIGS. 13 and 14, the channel aligner base plate 68 of the channel aligner 66 is slid into and secured in upstanding flaps 72 projecting from the base plates 14 of the adjacent channels 12. The wings 70 may include locking lances 74 that engage apertures 76 in the side walls 16 of the adjacent channels 12. The wings 70 releasably engage with the side walls 16 to align channels 12 along their respective lengths. One of skill in the art will understand that any type of interlocking structure between the channels 12 and the channel aligner 66 may be used. Use of the channel aligner 66 allows for fast, secure alignment and connection of the channels 12 of adjacent strip fixtures 10 in continuous row applications without the need for separate fasteners or tools. Moreover, because the channel aligner 66 is designed specifically for use as a connector, it does not include extraneous structure that obstructs the path within the channel for wire routing, as is the case when traditional end plates are used for this purpose, as illustrated in FIG. 2. The channel aligner 66 may be formed of any suitably rigid material, including but not limited to, metallic and polymeric materials.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A lighting fixture comprising:

(a) a channel comprising side walls each having a distal end and a base plate, wherein the side walls and the base plate define a channel cavity, and wherein each side wall comprises a length and at least one indentation integrally-formed in the side wall;

(b) at least one socket bracket coupled to the side walls of the channel and comprising an outer surface and an inner surface, wherein the inner surface faces the channel and encloses a first portion of the channel cavity;

(c) at least one lamp socket extending from the outer surface of the at least one socket bracket, wherein the at least one lamp socket is positioned outside the channel cavity and wherein the at least one lamp socket comprises wiring; and (d) a channel cover coupled to the side walls of the channel and enclosing a second portion of the channel cavity, wherein the second portion comprises substantially an entire longitudinal length of the channel cavity, wherein the channel cover comprises at least one relief channel in open communication with the entire longitudinal length of the second portion, wherein the wiring from the at least one lamp socket is positioned within the at least one relief channel, and wherein the distal end of at least one of the side walls of the channel is separated a distance from the channel cover by the at least one relief channel.

2. The lighting fixture of claim 1, wherein the channel cover snap-fits around the side walls of the channel.

3. The lighting fixture of claim 1, wherein the at least one relief channel comprises a substantially rectilinear-shaped recess.

4. The lighting fixture of claim 1, wherein the at least one indentation extends along substantially the entire length of each channel side wall.

5. The lighting fixture of claim 1, further comprising a tong hanger comprising two resilient side arms and a base plate, wherein each side arm extends from the base plate and comprises a hook distal the base plate that engages the at least one indentation on a side wall of the channel to releasably secure the channel to the tong hanger.

6. The lighting fixture of claim 5, wherein the tong hanger further comprises at least one hooker clip extending from the base plate and adapted to releasably secure the tong hanger to a support surface.

7. The lighting fixture of claim 6, wherein the at least one hooker clip is adapted to releasably secure the tong hanger in a plurality of orientations relative to the support surface.

8. A lighting assembly comprising:

(a) a lighting fixture comprising (i) a channel comprising side walls and a base plate, wherein each side wall comprises a length, a distal end, and at least one indentation that extends along at least a portion of the length of the side wall; and (ii) a channel cover that snap-fits onto the channel, wherein the channel cover comprises a non-planar base comprising a length and at least one relief channel that extends along at least a portion of the length of the non-planar base, wherein, when the channel cover snap-fits onto the channel, the distal end of at least one of the side walls of the channel is separated a distance from the channel cover by the at least one relief channel; and (b) a tong hanger comprising:

(i) two resilient side arms and a base plate, wherein each side arm extends from the base plate and comprises a hook distal the base plate that engages the at least one indentation on the side wall of the channel to releasably secure the channel to the tong hanger; and (ii) at least one hooker clip integrally formed with and extending from the base plate opposite the side arms and adapted to releasably secure the tong hanger to a support surface.

9. The lighting assembly of claim 8, wherein the indentation of each side wall is integrally-formed in the side wall.

10. The lighting assembly of claim 8, wherein the indentation of each side wall extends along substantially the entire length of the side wall.

11. The lighting assembly of claim 8, wherein the two resilient side arms and the base plate of the tong hanger are integrally-formed of spring steel.

12. The lighting assembly of claim 8, wherein the hook comprises a substantially V-shape.

13. The lighting assembly of claim 8, wherein the at least one hooker clip comprises a plurality of hooker clips.

14. The lighting assembly of claim 8, wherein the at least one hooker clip is adapted to releasably secure the tong hanger in a plurality of orientations relative to the support surface.

15. The lighting assembly of claim 8, wherein the support surface comprises a T-bar.

16. A method of installing a lighting fixture comprising a channel comprising two side walls each comprising a length, a distal end, and at least one indentation extending along at least a portion of the length with a tong hanger comprising (i) two resilient side arms and a base plate, wherein each side arm extends from the base plate and comprises a hook distal the base plate and (ii) at least one hooker clip integrally formed with and extending from the base plate opposite the side arms, the method comprising:

(a) positioning the lighting fixture so that the channel extends between the side arms of the tong hanger and the hook on each resilient side arm engages the at least one indentation on the side wall of the channel to releasably secure the channel to the tong hanger;

(b) connecting the at least one hooker clip to a support surface; and (c) snap-fitting a channel cover onto the channel, wherein the channel cover comprises a non-planar base comprising a length and at least one relief channel that extends along at least a portion of the length of the non-planar base, wherein, when the channel cover is snap-fitted onto the channel, the distal end of at least one of the side walls of the channel is separated a distance from the channel cover by the at least one relief channel.

* * * * *